US007123734B2

(12) United States Patent
Voth et al.

(10) Patent No.: US 7,123,734 B2
(45) Date of Patent: Oct. 17, 2006

(54) ANTENNA AND SPEAKER CONFIGURATION FOR A MOBILE DEVICE

(75) Inventors: David William Voth, Woodinville, WA (US); Dina Christine Taylor, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 651 days.

(21) Appl. No.: 10/411,657

(22) Filed: Apr. 11, 2003

(65) Prior Publication Data

US 2004/0204024 A1 Oct. 14, 2004

(51) Int. Cl.
*H04R 1/02* (2006.01)

(52) U.S. Cl. ..... 381/334; 455/562.1; 379/433.02

(58) Field of Classification Search ..... 381/87, 381/332, 334, 386; 455/90.3, 90.1, 95, 562.1, 455/575.1, 575.7, 350; 379/433.01, 433.02; 343/702

See application file for complete search history.

(56) References Cited

U.S. PATENT DOCUMENTS 6,144,738 A * 11/2000 Hawker et al. ..... 379/433.02
6,201,501 B1 3/2001 Arkko et al. ..... 343/702
6,307,520 B1 10/2001 Liu ..... 343/767
6,324,284 B1 11/2001 Hawker et al. ..... 379/433.02
6,483,466 B1 11/2002 Liu ..... 343/702
2002/0011959 A1 1/2002 Liu ..... 343/767
2002/0187758 A1 12/2002 Ylitalo et al. ..... 455/90
2003/0068987 A1 4/2003 Dufosse et al. ..... 455/90

FOREIGN PATENT DOCUMENTS

EP 1 091 539 A2 11/2001

OTHER PUBLICATIONS

Steve Allen, Ignatius Bezzman and Greg Richmond; "Cost and Size Reductions in Implementing Personal Wireless Communication Transceivers through advances in CMOS RF Integrated Circuits"; International Conference on Personal Wireless Communications, Mumbai, India, Dec. 17-19, 1997; pp. 133-137.

* cited by examiner

*Primary Examiner*—Ping Lee
(74) *Attorney, Agent, or Firm*—Merchant & Gould P.C.; Ryan T. Grace

(57) ABSTRACT

A speaker and antenna configuration for use in a mobile device. The speaker and antenna configuration includes a speaker, an antenna, and a circuit board. The circuit board includes at least one sound passageway. The speaker is mounted on one side of the circuit board such that sound from the speaker passes substantially through the sound passageway. The antenna is situated on the other side of the circuit board. In one embodiment, the antenna includes a perforation configured such that sound from the speaker passes substantially through the perforation.

25 Claims, 4 Drawing Sheets

ANTENNA AND SPEAKER CONFIGURATION FOR A MOBILE DEVICE

FIELD OF THE INVENTION

The present invention relates generally to speakers and antennas, and more particularly to a compact speaker and antenna configuration for mobile devices.

BACKGROUND OF THE INVENTION

As mobile telephone technology has advanced, the mobile telephone developers have concentrated on making the telephone smaller so that more volume and weight could be set aside for new features, while keeping the overall form-factor of the phone to be pocket-sized.

However, the quality of the sound reproduction is an important factor in a customer's decision to buy a mobile telephone. Audio quality of a speaker is determined by its frequency response over an audible frequency range, as well as a volume of space provided within a mobile telephone's case. Making mobile telephones smaller affects the volume of space available for the speaker, which in turn may negatively impact the frequency response of the speaker, and hence the customer's decision to purchase the mobile telephone.

In addition to reducing the size of the mobile telephone, mobile telephone developers may also provide antenna designs that include internal antenna arrangements. Placement of the antenna inside a case of the mobile telephone reduces the overall size of the mobile telephone -and prevents antenna breakage. However, improper placement of the internal antenna in relation to the speaker may result in interference that reduces the quality of the sound. Moreover, antennas must be oriented so that few telephone parts and external obstacles are interposed between an external radio source and the telephone antenna.

Deploying the antenna on a flip or a boom causes its own problems. A flip requires extra enclosing hardware, as well as a resilient path for conductors to carry signals between the flip and the main mobile device. More parts thus produce higher cost, greater weight, and lower reliability, as well as other problems. The same problems may apply to any other component, such as a speaker, that may be deployed on a flip or boom.

Therefore, the mobile telephone developer must design a combination of speaker, antenna, and case configuration that provides an acceptable audio quality with minimum antenna interference within a limited space. Thus, it is with respect to these considerations and others that the present invention has been made.

SUMMARY OF THE INVENTION

The present invention is directed to addressing the above-mentioned shortcomings, disadvantages and problems, and will be understood by reading and studying the following specification.

The present invention provides a system, apparatus, and method directed to a speaker and antenna configuration for use in a mobile device. The speaker and antenna configuration includes a speaker, an antenna, and a circuit board. The circuit board includes a passageway. The speaker is mounted on one side of the circuit board such that sound from the speaker passes substantially through the passageway. The antenna is situated on the other side of the circuit board. In one embodiment, the antenna includes a perforation configured such that sound from the speaker passes substantially through the perforation.

In one aspect of the present invention, a speaker and antenna device is directed to use in a mobile telephone having a back case. The configuration includes a circuit board that has a passageway, the speaker, and the antenna. The speaker is mounted on one side of the circuit board in sufficient proximity to the passageway such that sounds from the speaker travels through the passageway. The antenna is located within the case and on the other side of the circuit board. The speaker and antenna configuration is further configured so that the antenna includes at least one perforation arranged so that sound from the speaker passes through at least one perforation.

In another aspect of the present invention, a method is directed to communicating sound through a mobile device. A circuit board is horizontally disposed between a mobile speaker and a mobile antenna. The circuit board includes a passageway traversing the circuit board. A sound wave is emitted from the mobile speaker, and traverses substantially through the passageway in the circuit board towards the mobile antenna.

BRIEF DESCRIPTION OF THE DRAWINGS

The foregoing aspects and many of the attendant advantages of the present invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention now will be described more fully hereinafter with reference to the accompanying drawings, which form a part hereof, and which show, by way of illustration, specific exemplary embodiments through which the present invention may be practiced. The present invention may, however, be embodied in many different forms and should not be construed as limited to the embodiments set forth herein; rather, these embodiments are provided so that this disclosure will be thorough and complete, and will fully convey the scope of the present invention to those skilled in the art. Like numbers refer to like elements throughout. The following detailed description is, therefore, not to be taken in a limiting sense.

Throughout the specification and claims, the following terms take the meanings explicitly associated herein, unless the context clearly dictates otherwise.

The term "connected" means a direct connection between the things that are connected, without any intermediary devices or components.

The term "coupled," means a direct connection between the things that are connected, or an indirect connection through one or more either passive or active intermediary devices or components.

The terms "comprising," "including," "containing," "having," and "characterized by," mean an open-ended or inclusive transitional construct and does not exclude additional, unrecited elements, or method steps. For example, a combination that comprises A and B elements, also reads on a combination of A, B, and C elements.

The meaning of "a," "an," and "the" include plural references. The meaning of "in" includes "in" and "on." Additionally, a reference to the singular includes a reference to the plural unless otherwise stated or is inconsistent with the disclosure herein.

Briefly stated, the present invention is directed towards providing a speaker and antenna system and method for use in a mobile device, such as a mobile telephone. A speaker and antenna configuration includes a speaker, an antenna, and a circuit board. The circuit board includes at least one passageway. The speaker is mounted on one side of the circuit board such that sound from the speaker passes substantially through the passageway. The antenna is situated on the other side of the circuit board.

Illustrative Operating Environment

Figure 1:
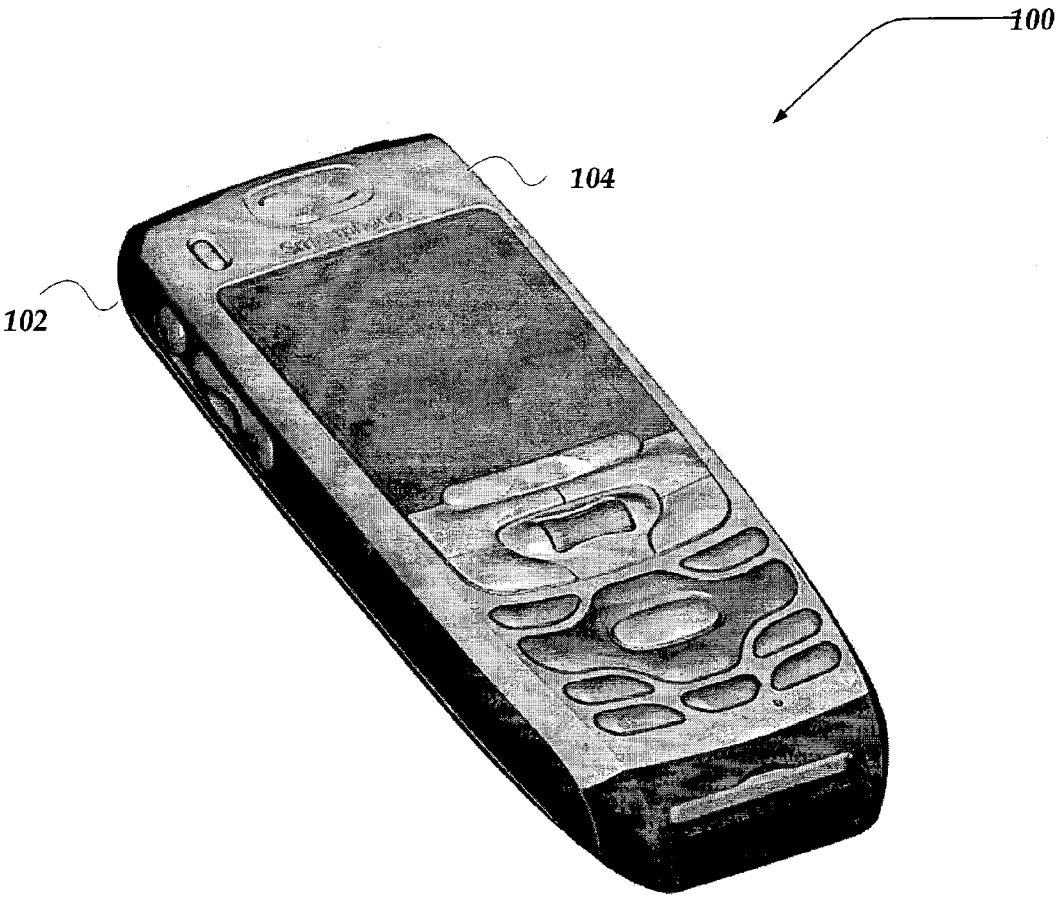
FIG. 1 shows an illustration of an exemplary environment for practicing the invention.
Figure 3:
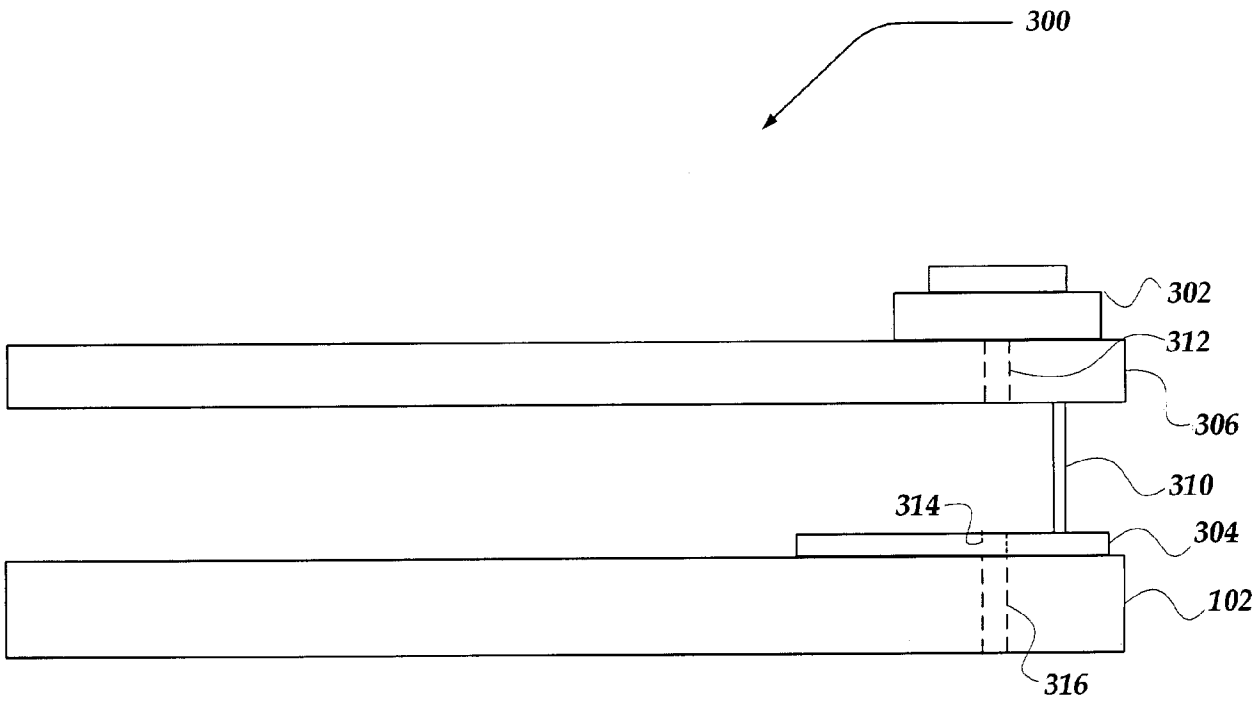
FIG. 3 is a side cut away view of one embodiment of an antenna and speaker configuration.

FIG. 1 shows an illustration of an exemplary communications device 100 for practicing the invention, in accordance with the present invention. Communications device 100 may include many more or less components than those shown. The components shown, however, are sufficient to disclose an illustrative embodiment for practicing the invention. Communications device 100 includes back case 102 and front case 104. Together, they form a casing to communications device 100. The casing to communications device 100 however, is not so limited, and may be formed in virtually any manner to provide a protective cover for internal electronics. For example, the casing may include a side casing that wraps around the internal electronic and connects to front case 104 and back case 102. Internal electronics may include, among other things, a speaker and antenna configuration for providing and receiving audio signals. One embodiment of a speaker and antenna configuration is described in more detail below in conjunction with FIG. 3. In another embodiment of the present invention, back case 102 includes one or more perforations (as shown in FIG. 3) through which audio signals may travel.

Generally, communications device 100 may include virtually any portable computing device capable of receiving and transmitting signals between another communications device, and providing audio signals, such as ringer tones, and the like. Such devices include cellular telephones, smart phones, audio pagers, radio frequency (RF) devices, infrared (IR) devices, integrated devices combining one or more of the preceding devices, and the like. Communications device 100 may also include other devices, such as Personal Digital Assistants (PDA) with audio functions, handheld computers, wearable computers, and the like. As such, communications device 100 typically ranges widely in terms of capabilities and features.

Figure 2:
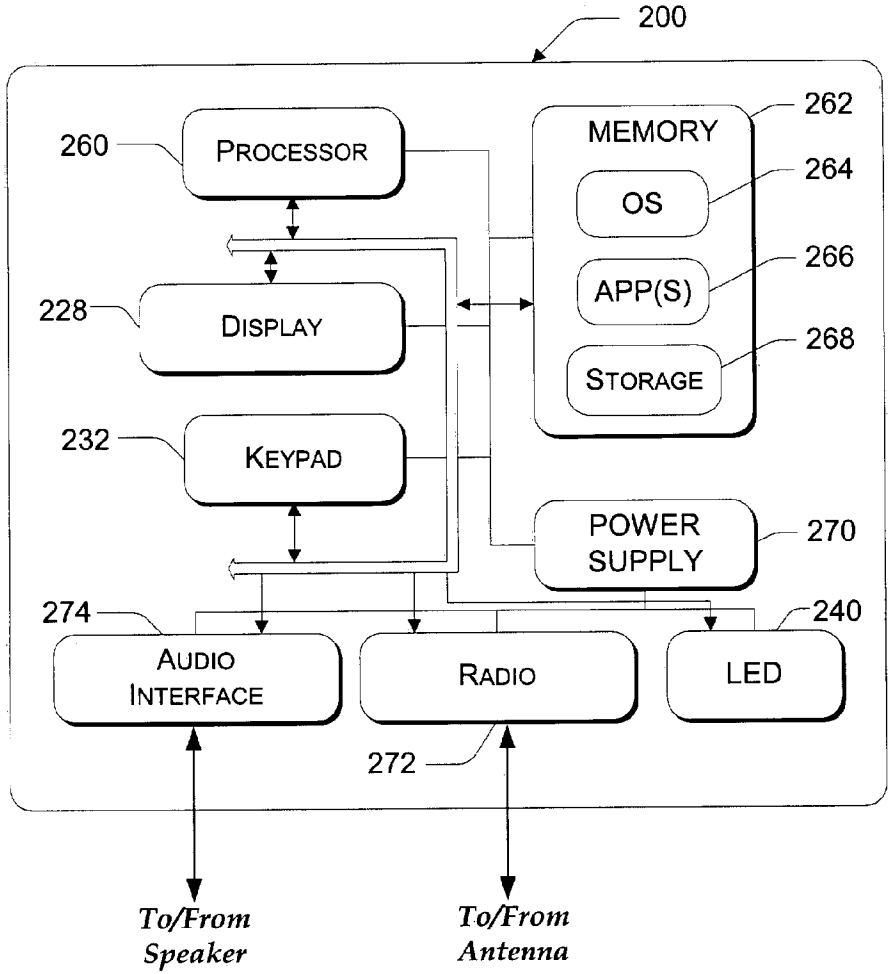
FIG. 2 is a functional block diagram illustrating an embodiment of internals for the exemplary system shown in FIG. 1.

FIG. 2 is a functional block diagram illustrating an embodiment of internals 200 for use in communications device 100 of FIG. 1, in accordance with the present invention. Internals 200 may include many more or less components than those shown. The components shown, however, are sufficient to disclose an illustrative embodiment for practicing the invention. In one embodiment, the internals 200 include a printed circuit board (PCB), such as described below in conjunction with FIG. 3. The components illustrated in FIG. 2 may be coupled to the printed circuit board.

As shown in the figure, the internals 200 include processor 260, memory 262, display 228, and keypad 232. Memory 262 generally includes both volatile memory (e.g., RAM) and non-volatile memory (e.g., ROM, Flash Memory, or the like). Internals 200 may include an operating system 264, which is resident in memory 262 and executes on processor 260. Keypad 232 may be a push button numeric dialing pad (such as on a typical telephone), a thumb-wheel, or the like. Display 228 may be a liquid crystal display, or any other type of display commonly used in a mobile communications device. For example, display 228 may be touch-sensitive, and would then also act as an input device.

One or more application programs 266 may be loaded into memory 262 and run on operating system 264. Examples of application programs include phone dialer programs, email programs, user ringer tone selection programs, and so forth. The internals 200 also include non-volatile storage 268 within memory 262. Non-volatile storage 268 may be used to store persistent information which should not be lost if the internals 200 are powered down. The application programs 266 may use and store information in storage 268, such as e-mail, user selectable ringer tones, and the like.

The internals 200 also include power supply 270, which may be implemented as one or more batteries. Power supply 270 might further include an external power source, such as an AC adapter or a powered docking cradle that supplements or recharges the batteries.

The internals 200 are also shown with two types of external notification mechanisms: LED 240 and audio interface 274. These devices may be directly coupled to power supply 270 so that when activated, they remain on for a duration dictated by the notification mechanism even though processor 260 and other components might shut down to conserve battery power. LED 240 may be programmed to remain on indefinitely until the user takes action to indicate the powered-on status of the device. Audio interface 274 is used to provide audible signals to and receive audible signals from the user. For example, audio interface 274 may be coupled to a speaker, such as described in conjunction with FIG. 3, for providing audible output. Audio interface 274 may also, be coupled to a microphone, receiving speaker, or the like, for receiving audible input, such as to facilitate a telephone conversation.

Internals 200 also include radio 272 that performs the function of transmitting and receiving radio frequency communications. Radio 272 may be coupled to an antenna such one described in conjunction with FIG. 3. Radio 272 facilitates wireless connectivity between internals 200 and the outside world, via a communications carrier or service provider. Transmissions to and from radio 272 are conducted under control of operating system 264. In other words, communications received by radio 272 may be disseminated to application programs 266 via operating system 264, and vice versa.

Radio 272 allows internals 200 to communicate with other computing devices, such as over a network. Radio 272 is one example of communication media. Communication media may typically be embodied by computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

FIG. 3 is a side cut away view of one embodiment of an antenna and speaker configuration, in accordance with one embodiment of the invention. Antenna and speaker configuration 300 may include many more components than those shown. The components shown, however, are sufficient to disclose an illustrative embodiment for practicing the invention.

Antenna and speaker configuration 300 includes Printed Circuit Board (PCB) 306, speaker 302, internal antenna 304, and back case 102. Speaker 302 is coupled to PCB 306. Internal antenna 304 is in communication with PCB 306. PCB 306 is disposed between speaker 302 and the internal antenna 304. PCB 306 is the main supporting surface for speaker 302. In one embodiment, the inside of back case 102 provides a surface for mounting internal antenna 304.

Although not shown, either side of PCB 306 may operate as a ground plane. PCB 306 may include any of a variety of circuit boards used for mobile communications devices, including but not limited to, prototype boards, wire wrap boards, photoplot boards, or the like. In one embodiment, PCB 306 is employed as the circuit board on which the components described in FIG. 2 are coupled.

PCB 306 includes at least one sound passageway 312 through the circuit board. Sound passageway 312 may traverse PCB 306 substantially perpendicular to the front and backsides of PCB 306. Sound passageway 312 may be square, rectangular, round, or any other shape. Moreover, sound passageway 312 may include multiple passageways through PCB 306. In one embodiment, at least one sound passageway 312 is in sufficient proximity with conduction passageways (not shown) in speaker 302 such that sound from speaker 302 travels through at least one sound passageway 312. Sound passageway 312 is sufficiently small to minimize electromagnetic interference of signals between internal antenna 304 and speaker 302. In one embodiment, sound passageway 312 has a diameter that is less than approximately one wavelength of internal antenna 304. In another embodiment, each sound passageway 312 is approximately 1 mm to approximately 1.8 mm in diameter.

Speaker 302 may include virtually any sound device that is configured to provide tones, buzzes and other audio signals for communications device 100. In one embodiment, speaker 302 is enabled to play user selectable ringer tones. Speaker 302 may be virtually any shape and size that fits reasonably within communications device 100 of FIG. 1. For example, speaker 302 may be square, rectangular, round, or any other shape. In one embodiment, speaker 302 is about 2 mm to about 5 mm in overall height, with a diameter of about 14 mm to about 18 mm.

Speaker 302 may be connected to PCB 306 employing virtually any manner that enables a substantially airtight seal between speaker 302 and PCB 306 that minimizes audio waves from escaping around the airtight seal. For example, speaker 302 may be coupled to PCB 306 employing glue, solder, screws, tape, plastic covers, and the like.

Moreover, speaker 302 is arranged to face its audio output side towards PCB 306, and away from the front of communications device 100. This arrangement is directed at minimizing directing tones, and other potentially loud sounds towards a user's ear.

In one embodiment, speaker 302 is a dual function receiver/speaker manufactured by Transducers, Inc. under part number of TRDF-1508-1232-SCMS. Such speaker arrangement includes two interconnected speakers arranged facing approximately opposite directions to each other. One interconnected speaker of speaker 302 faces substantially outwards from PCB 306 and is configured to operate as a transceiver enabling audio signals, such as voice signals, to be received and transmitted by communications device 100 of FIG. 1. The transceiver is about 8 mm to about 15 mm in size, with a power output of about 40 mW to about 60 mW. The second interconnected speaker of speaker 302 is arranged to face substantially towards one side of PCB 306. The second interconnected speaker is configured to operate as a loudspeaker providing ring tones, play sounds, and the like. As such, it is desirable to arrange the second interconnected speaker to face its audio output side away from a user's ear. In one embodiment, loudspeaker is about 15 mm to about 18 mm in diameter, and configured with a power output of about 0.1 W to about 0.6 W. Moreover, such interconnected speakers are arranged to share a single magnet, thereby minimizing the overall space requirements with the casing. However, the present invention is not so limited, and virtually any speaker arrangement may be employed within communications device 100, without departing from the scope and spirit of the present invention.

Internal antenna 304 connects to PCB 306 by virtually any means known in the art to connect antennas, such as connector 310, to filter, amplifier, or radio circuitry located on or below the ground plane associated with PCB 306.

Generally, internal antenna 304 is mounted on the internal side of back case 102, in a manner substantially parallel with PCB 306. Moreover, the volume of space between PCB 306 and back case 102 is directed to minimize electromagnetic interference between speaker 302 and internal antenna 304, and to optimize the reception characteristics of antenna, while minimizing the overall size and thickness of communications device 100 of FIG. 1. In one embodiment, the distance between speaker 302 and internal antenna 304 is approximately 6.5 mm to approximately 7 mm. Moreover, internal antenna 304 is oriented within communications device 100 of FIG. 1, so that a minimum of other components is interposed between it and an external radio source. In another embodiment, the available antenna space between PCB 306 and back case 102 is approximately 37 mm wide by approximately 24 mm long by approximately 5.8 mm in height tampering down to approximately 3 mm towards one end of back case 102. However, the present invention is not limited to these dimensions and the resulting volume, and other dimensions and resulting volumes may be employed without departing from the scope or spirit of the invention.

Internal antenna 304 may be fixed, extendable, patch, or a micro strip configuration usable for transmitting and receiving signals. Similarly, internal antenna 304 may be an elliptically polarized antenna, or rectangularly shaped. In one embodiment, internal antenna 304 is a rectangularly shaped etched metallic film that is mounted on the inside of back case 102.

In another embodiment, internal antenna 304 includes at least one perforation 314 through which audio signals may travel. Moreover, as back case 102 may include one or more casing perforations 316, audio signals may travel through internal antenna 304, through casing perforations 316, and out of communications device 100 of FIG. 1.

Figure 4:
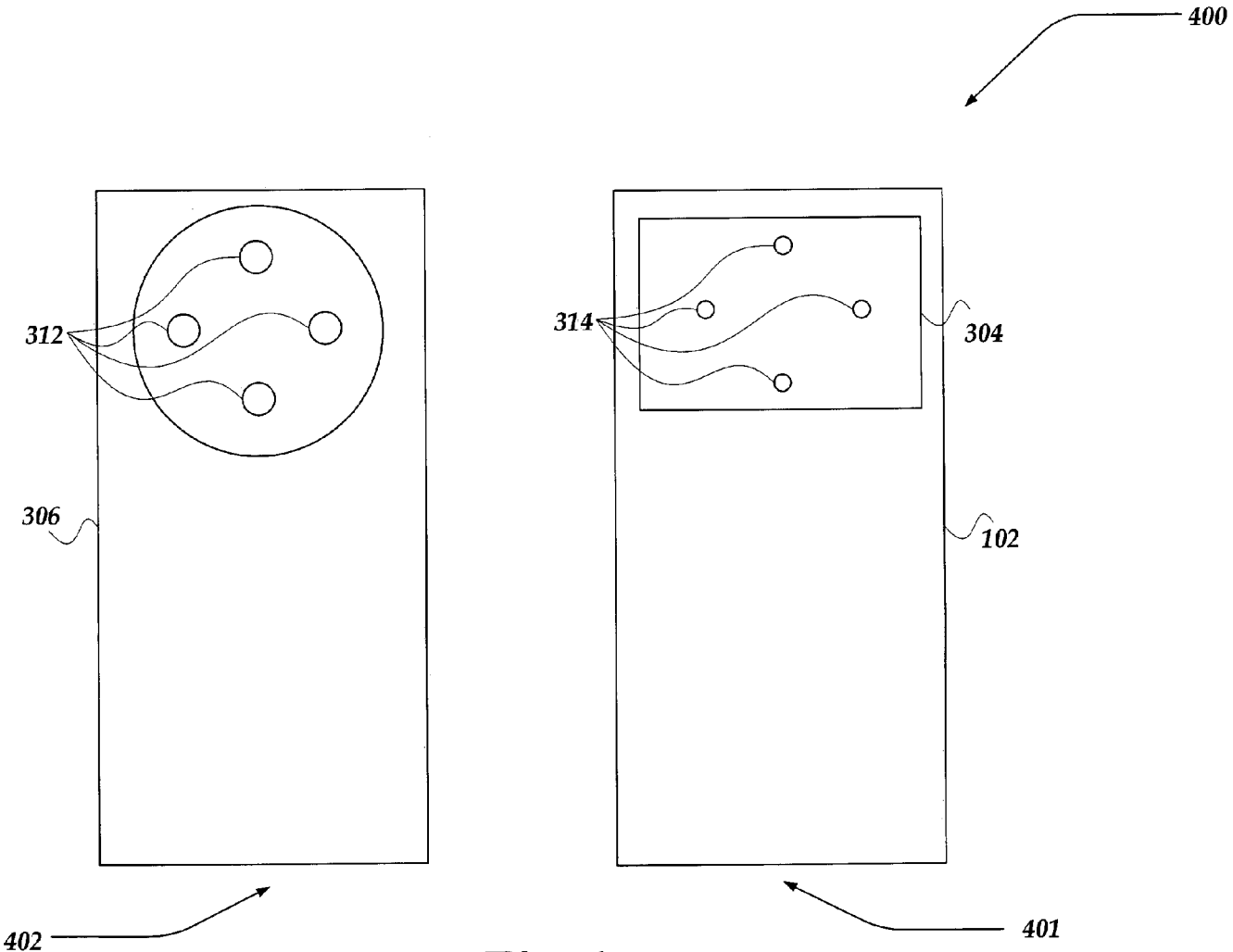
FIG. 4 is a facial view of a case with antenna, and a circuit board including at least one sound passageway, in accordance with the present invention.

FIG. 4 is a facial view 401 of a back case including antenna, and a back facial view 402 of a circuit board including at least one sound passageway, in accordance with the present invention. As shown in the figure, facial view 400 includes PCB 306 and the internal side of back case 102. Also shown, PCB 306 includes multiple sound passageways 312 that traverse PCB 306 in a substantially perpendicular plane to the front and backsides of PCB 306. Back case 102 includes internal antenna 304. Internal antenna 304 further includes multiple perforations 314 that may be aligned in a substantially similar arrangement to sound passageways 312.

For ordinary voice functions, such as receiving or replaying voice through a speaker, the communications device is operated such that the receiving speaker receives and produces audio signals that traverse at least one perforation in the front case. For example, referring to FIG. 3, voice functions may be enabled through the transceiver speaker component of speaker 302.

For ring tones, buzzes, and the like, the communications device is operated such that the loudspeaker emits audio signals towards at least one sound passageway through PCB. For example, referring to FIG. 3, ring tones may be enabled through the loudspeaker component of speaker 302. Because the loudspeaker may be mounted on PCB so as to create substantially an airtight seal between the loudspeaker and the PCB, the audio signals from the loudspeaker travel substantially through the sound passageway in the PCB. Audio signals substantially enter and the casing cavity between the PCB and back casing. Perforations in the back casing enable the sound waves to travel though the back casing and escape the communications device.

The above specification, examples, and data provide a complete description of the manufacture and use of the composition of the invention. Since many embodiments of the invention can be made without departing from the spirit and scope of the invention, the invention resides in the claims hereinafter appended.

We claim:

1. A speaker and antenna configuration for use in a mobile device having a case, comprising:

a circuit board having a first side, a second side, and a passageway through the circuit board;

a speaker mounted to the first side of the circuit board proximal to the passageway such that sound from the speaker travels through the passageway; and an antenna configured for a mobile station to transmit and receive cellular transmissions, wherein the antenna has a first side, a second side and at least one perforation through the antenna, wherein the antenna is located within the case proximal the second side of the circuit board.

2. The speaker and antenna configuration of claim 1, wherein the antenna is mounted to the of the circuit board.

3. The speaker and antenna configuration of claim 1, wherein the antenna is mounted to the internal side of the case.

4. The speaker and antenna configuration of claim 1, wherein the antenna is substantially parallel to the circuit board.

5. The speaker and antenna configuration of claim 1, wherein the antenna further comprises at least one perforation arranged so that sound from the speaker passes through the at least one perforation.

6. The speaker and antenna configuration of claim 1, wherein the speaker further comprises two interconnected speakers with at least one interconnected speaker being aligned substantially over the passageway in the circuit board.

7. The speaker and antenna configuration of claim 1, wherein the passageway in the circuit board further comprises a diameter that is less than approximately a wavelength associated with the antenna.

8. The speaker and antenna configuration of claim 1, wherein the speaker mounted on the front side of the circuit board further comprises mounting the speaker in sufficient proximity to the circuit board to create substantially an airtight seal between the circuit board and the speaker.

9. The speaker and antenna configuration of claim 1, wherein the antenna further comprises at least one of a fixed, an extendable, a patch, and a microstrip antenna.

10. The speaker and antenna configuration of claim 1, wherein the case further comprises a perforation through the case and in substantially parallel alignment with the passageway in the circuit board to enable sound from the speaker to substantially travel through the case perforation.

11. The speaker and antenna configuration of claim 1, wherein the antenna has at least one of a rectangular, and a circular shape.

12. A mobile apparatus, comprising:

a case;

a circuit board having a front side, a backside, and a sound passageway;

a speaker mounted to the front side of the circuit board adjacent to the sound passageway to enable sound from the speaker to substantially pass through the sound passageway; and an internal antenna configured for a mobile station to transmit and receive cellular transmissions, wherein the internal antenna has at least one perforation through the antenna located proximal to the back side of the circuit board.

13. The mobile apparatus of claim 12, wherein the antenna is mounted to the internal side of the back case.

14. The mobile apparatus of claim 12, wherein the speaker further comprises two interconnected speakers wit at least one of the interconnected speakers being aligned substantially over the sound passageway in the circuit board.

15. The mobile apparatus of claim 12, wherein the sound passageway in the circuit board further comprises a diameter that is less than approximately a wavelength associated with the antenna.

16. The mobile apparatus of claim 12, wherein the sound passageway further comprises at least two sound passageways.

17. A speaker and antenna device for use in a mobile telephone having a back case, comprising:

a circuit board having a front side and a backside and including a sound passageway traversing through the circuit board between the front side and the backside;

a speaker mounted to the front side of the circuit board facing the sound passageway and in sufficient proximity to the sound passageway so that sound from the speaker travels substantially through the sound passageway; and an antenna configured for a mobile station to transmit and receive cellular transmissions, wherein the antenna has at least one perforation through the antenna mounted internal to the back case and situated substantially parallel to the backside of the circuit board.

18. The speaker and antenna device of claim 17, wherein the antenna further comprises at least one perforation arranged so that sound from the speaker passes through at least one perforation.

19. The speaker and antenna device of claim 17, wherein the case further comprises at least one perforation through the case and in substantially parallel alignment with the sound passageway in the circuit board to enable sound from the speaker to substantially travel through the case perforation.

20. A speaker and antenna system for use in a mobile device, comprising;

a circuit board having a first side, a second side, and an opening extending therethrough;

a mobile speaker mounted to the first side of the circuit board over the opening in the circuit board so that sound from the mobile speaker passes through the opening; and a mobile antenna configured for a mobile station to transmit and receive cellular transmissions, wherein the antenna has a perforation extending therethrough to permit sound to pass through the perforation, wherein the mobile antenna is positioned proximal the second side of the circuit board so that sound generated by the mobile speaker passes through the opening of the circuit board before passing through the perforation in the antenna.

21. The speaker and antenna system of claim 20, wherein the speaker further comprises two interconnected speakers with one of the interconnected speakers being aligned substantially over the opening in the circuit board.

22. The speaker and antenna system of claim 20, wherein the opening in the circuit board further comprises a diameter that is less than approximately a wavelength associated with the antenna.

23. A method for communicating sound through a mobile device, comprising;

providing a circuit board having a first side, a second side, and a passageway from the first side to the second side;

mounting a mobile sneaker to the first side of the circuit board so that sound generated by the mobile speaker in a first direction substantially passes through the passageway;

providing a mobile antenna having a perforation extending through the mobile antenna; and positioning the mobile antenna proximal to the second side of the circuit board so that sound generated by the mobile speaker in the first direction substantially passes through the passageway before passing through the perforation wherein the mobile antenna is configured for a mobile station to transmit and receive cellular transmissions.

24. The method of claim 23, wherein the circuit board includes a plurality of passageways and the mobile antenna includes a plurality of perforations.

25. The method of claim 23, wherein mounting a mobile speaker to the first side of the circuit board includes mounting the speaker to create a substantially airtight seal between the mobile speaker and the circuit board so that sound substantially passes through the passageway.

* * * * *